United States Patent [19]

Ruger et al.

[11] Patent Number: 4,577,430

[45] Date of Patent: Mar. 25, 1986

[54] TRIGGER AND SPRING MOUNT MECHANISM

[75] Inventors: William B. Ruger, Croydon, N.H.; Lawrence L. Larson, Branford, Conn.

[73] Assignee: Sturm, Ruger & Company, Inc., Southport, Conn.

[21] Appl. No.: 624,181

[22] Filed: Jun. 25, 1984

[51] Int. Cl.[4] ..... F41C 19/00

[52] U.S. Cl. ..... 42/69 R; 42/69 B

[58] Field of Search ..... 42/69 R, 69 A, 69 B

[56] References Cited

U.S. PATENT DOCUMENTS 2,342,283 2/1944 Hyde ..... 42/69 A 3,152,418 10/1964 Charron ..... 42/69 B

*Primary Examiner*—Charles T. Jordan

*Assistant Examiner*—Ted L. Parr

*Attorney, Agent, or Firm*—Pennie & Edmonds

[57] ABSTRACT

A trigger mechanism for firearms having a slide, a trigger and a trigger bar in which the trigger includes a cam section which is mounted for rotary movement in a frame recess housing. A spring biasing arrangement urges the trigger cam against frame recess surfaces and urges its trigger bar against the slide.

3 Claims, 13 Drawing Figures

TRIGGER AND SPRING MOUNT MECHANISM

BACKGROUND OF THE INVENTION

Firearms operable manually have included triggers for pulling by the operator which triggers are pivoted about a fixed axis. Rotation of the trigger about such an axis provides for a sufficient force to operate trigger bars, and sears in combination with hammers to initiate and accomplish discharge of the firearms.

SUMMARY OF THE INVENTION

Broadly, the present invention is a trigger mount mechanism in which the trigger is mounted for rotation about trigger cam sections and a spring biasing arrangement urges the trigger and associated trigger bar against the slide.

It is a feature that the barrel and barrel mount are able to retract and lower without interfering with the trigger mount mechanism.

It is also a feature that the spring biasing system is operated to return both the trigger and trigger bar to their at-rest positions.

DESCRIPTION OF THE PREFERRED EMBODIMENT

Figure 1:
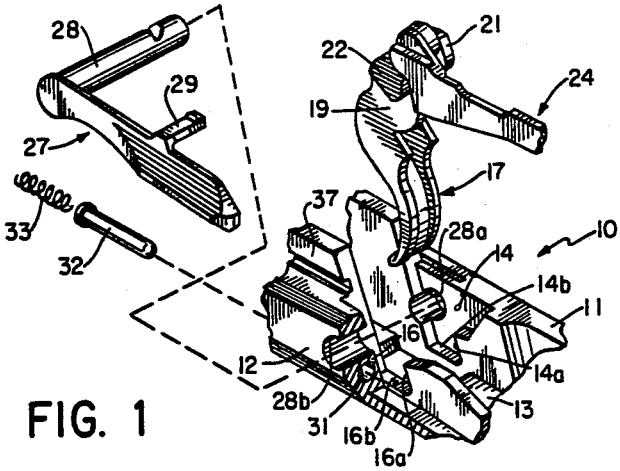
FIG. 1 is a perspective exploded view of the trigger mount and spring mechanism.
Figure 2:
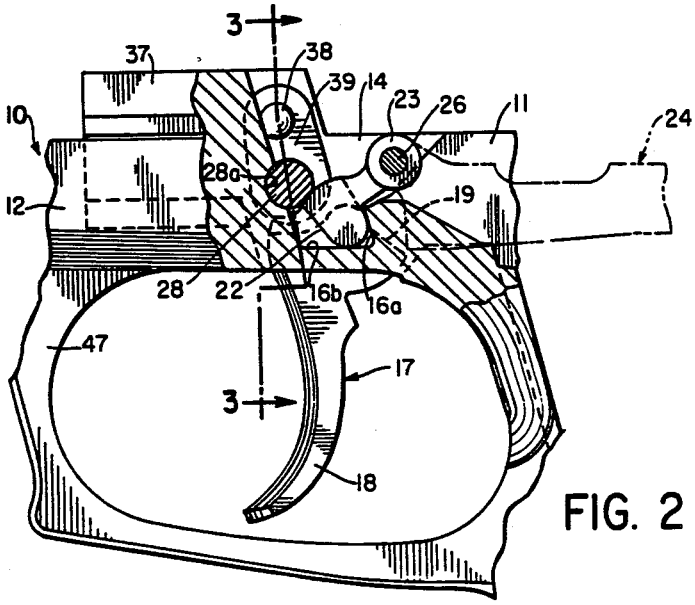
FIG. 2 is a side sectional view showing the trigger mechanism.
Figure 3:
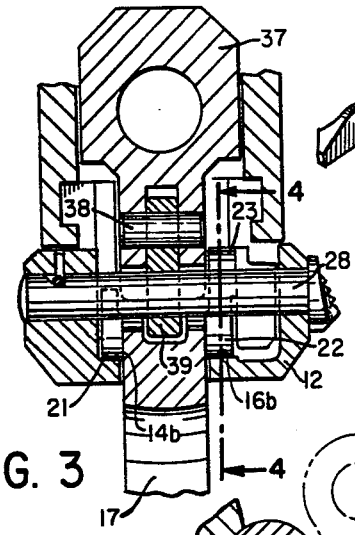
FIG. 3 is a sectional view along line 3—3 of FIG. 2.

In FIGS. 1–3, pistol frame 10 includes right vertical frame section 11, left vertical frame section 12 and horizontal bottom frame section 13. Right frame recess 14 and left frame recess 16 are shaped and spaced-apart to serve rotatable bearing cams 21, 22 positioned on trigger 17.

Trigger 17 includes finger grip section 18, body portion 19 and right and left bearing cams 21, 22. Trigger 17 also has a trigger extension 23 for pivotable connection with trigger bar 24. Trigger bar 24 rotates about trigger 17 through pin 26.

Right frame recess 14 includes a mount bearing upstanding surface **14*a* and a generally horizontal surface 14*b*. Likewise, left frame recess 16 has upstanding surface 16*a* and horizontal surface 16*b***.

Also shown in FIGS. 1–3 are slide stop 27 including slide stop pivot axis 28 and slide latch piece 29. Stop pivot axis 28 is rotatably mounted in frame openings **28*a* and 28*b* and serves to confine and control bearing cams 21, 22 movement. Cams 21, 22 are normally biased against surfaces 14*a*, 14*b*, 16*a*, 16*b* but when forces, such as the operators manipulation of the firearm, cause the trigger 17 to move forward pivot axis 28 limits such movement. Plunger channel 31 in left side frame section 16 carries trigger bar plunger 32 and plunger spring 33 which bear against the trigger bar 24** to urge it into various positions as described below.

Turning to FIGS. 2 and 3, barrel 36 including barrel support section 37 are mounted for rotation about barrel pivot 38 through barrel link 39.

Figure 5:
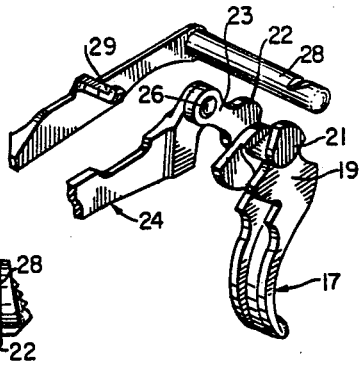
FIG. 5 is a perspective view of the trigger and slide stop.
Figure 4:
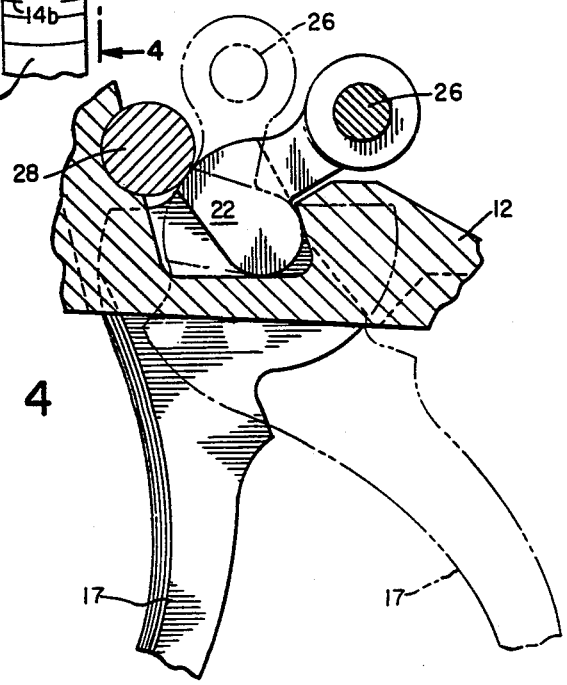
FIG. 4 is a sectional view along line 4—4 of FIG. 3.
Figure 6:
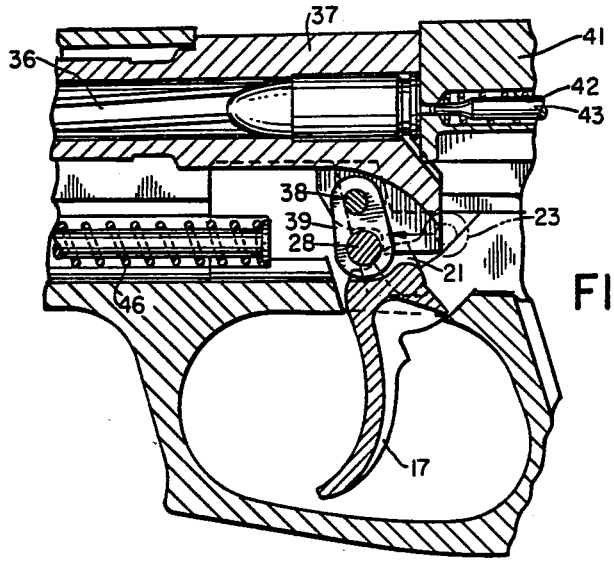
FIG. 6 is a side elevational view showing the slide forward.
Figure 7:
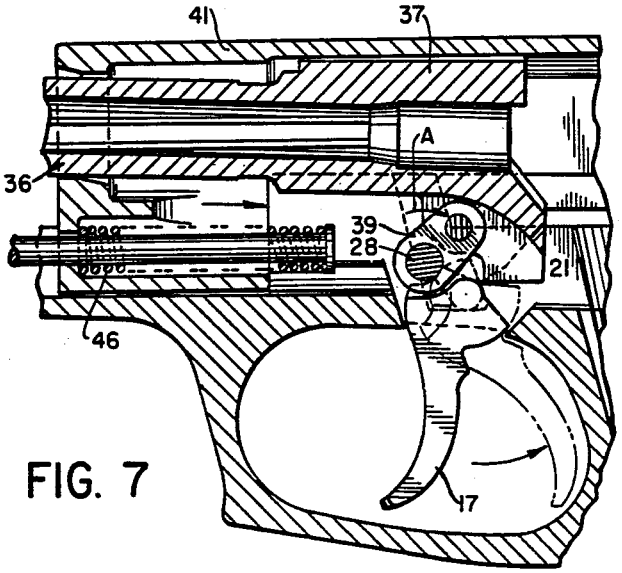
FIG. 7 is a side elevational view showing the slide back and barrel lowered.

Turning to FIGS. 6 and 7, slide 41 includes firing pin recess 42 and firing pin 43. Slide return spring 46 and trigger guard 47 are also shown. After the trigger 17 is pulled back to fire causing the pistol to discharge, slide 41 and barrel 36 disengage and the slide then moves rearwardly allowing barrel support section 37 to rotate about pivot 38 as link 39 rotates about slide pivot pin 28 in the direction of arrow A (FIG. 7). Trigger 17 as mounted for rotation does not interfere with the recoil and return of slide 42 and barrel 36. Since cams 21 and 22 are spaced apart providing an opening therebetween (FIG. 5), this construction allows barrel link 39 to lower between trigger cams 21, 22 where normally there is a pivot pin in prior firearms. This arrangement also permits the trigger mechanism to be located farther to the rear of the firearm. Alternatively, a single trigger bearing cam offset to one side could be used provided it was shaped to provide for stable turning of the trigger during firearm operation.

Figure 8:
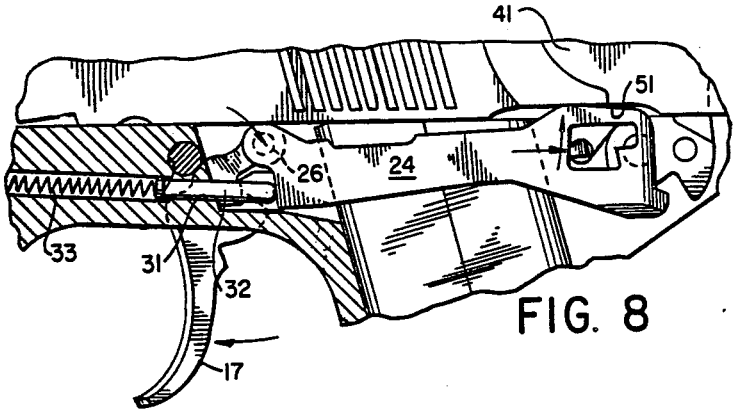
FIG. 8 is a partial side elevational view showing the trigger bar pivoted on the trigger and spring system urging the bar rearward and upward.
Figure 9:
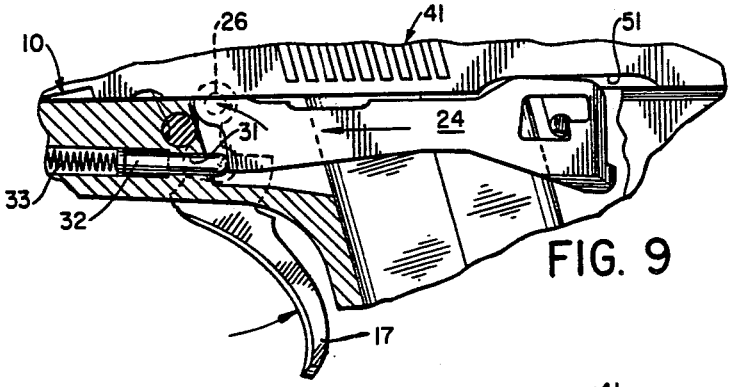
FIG. 9 is a view similar to FIG. 8 with the slide forward; the trigger back; and the trigger bar up and forward under spring biasing.
Figure 10:
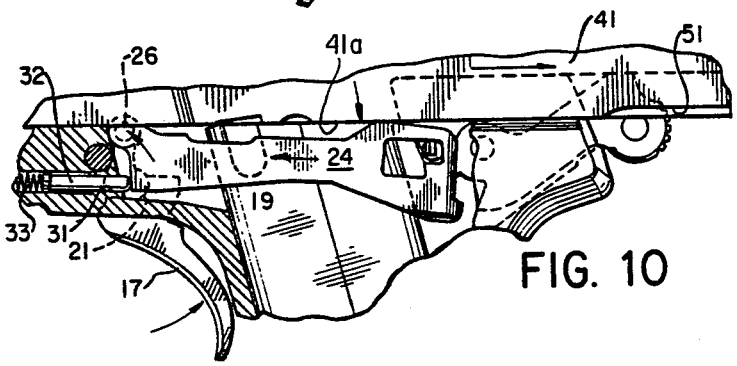
FIG. 10 is a view similar to FIG. 9 with the slide back and the trigger bar moved downwardly.

Turning to FIGS. 8–13, trigger bar 24 is shown positioned below and urged against slide 41. With the slide 41 forward and trigger 17 forward (or back), bar 24 rides in slide recess 51 (FIGS. 8 and 9). With slide 41 back during recoil, bar 24 is lowered as it moves out of recess 51 and is acted upon by slide surface **41*a* (FIG. 10**).

Figure 11:
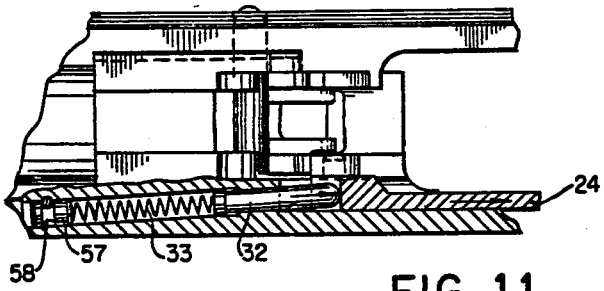
FIG. 11 is a plan sectional view of the spring system urging the trigger bar rearward.
Figure 12:
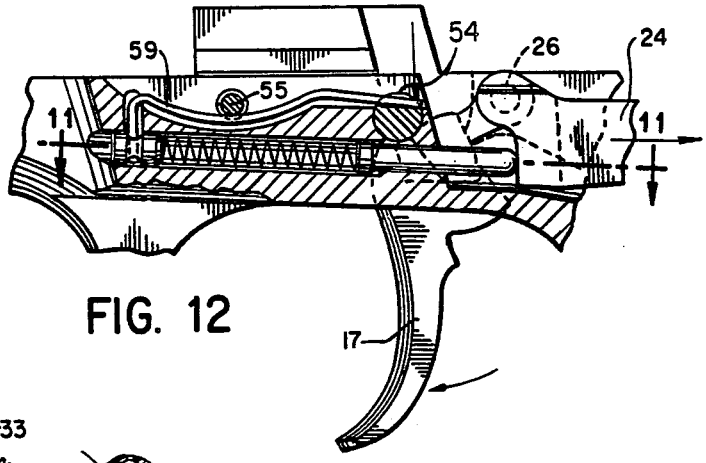
FIG. 12 is an elevational sectional view of the spring system and trigger bar, and spring means for keeping the slide latch disengaged from the slide.
Figure 13:
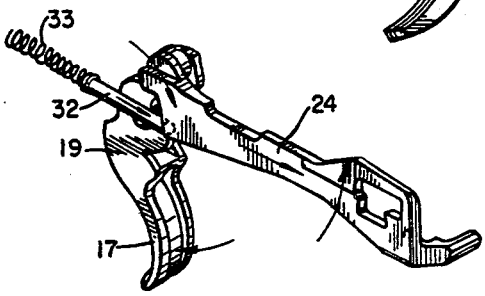
FIG. 13 is a perspective view of the trigger bar, connected to the trigger and spring plunger, and spring.

Trigger bar 24 is pivotably connected to trigger 17 about pin 26 and is urged rearwardly and upwardly by plunger 32 positioned in tubular frame recess 31 (see also FIG. 1). Plunger 32 is urged rearwardly by coil spring 33 mounted in spring base piece 57 (FIG. 11). Spring base piece 57 includes detent groove 58 which accommodates detent spring 59 to hold base piece 57 in position (FIGS. 11 and 12). Detent spring 59 is held by retaining pin 55 and spring 57 sits in groove 54 of slide pivot pin 28.

With particular reference to FIG. 11, it is seen that plunger 32 engages trigger bar 24 to urge bar 24 in a rearwardly and upwardly direction.

We claim:

1. In a firearm having a trigger mounted for movement therein the improvement comprising (a) a trigger body including a finger grip section, a central trigger section and a trigger arm engaging section;

(b) a bearing cam positioned on the trigger body;

(c) a recess in the firearm frame for receiving the bearing cam; the recess including two substantially planar surfaces whose planes intersect; and (d) arcuate retaining means adjacent the recess for preventing the bearing cam from moving out of the recess whereby the trigger body is pivotable about its bearing cam which cam is movable against the arcuate retaining means and the recess planar surfaces.

2. The improvement of claim 1 in which the trigger body carries a plurality of bearing cams, each mounted in a recess with each recess having two planar bearing surfaces, and an adjacent arcuate retaining means.

3. In a semi-automatic firearm having a slide; a trigger and a pivotably connected trigger bar, the improvement comprising (a) a trigger body including a finger grip section, a central trigger section and a trigger arm engaging section;

(b) a trigger bar pivotably connected to the trigger arm engaging section, the upward movement of such bar being limited by the slide;

(c) a plurality of spaced-apart bearing cams on the central trigger section;

(d) bearing cam pivotable housing means for each bearing cam, each such housing means comprising two substantially planar surfaces whose planes intersect and an arcuate retaining surface; and (e) spring means urging the trigger arm rearwardly and upwardly.

* * * * *